US008668496B2

(12) United States Patent
Nolen

(10) Patent No.: US 8,668,496 B2
(45) Date of Patent: Mar. 11, 2014

(54) TRAINING SYSTEM

(76) Inventor: Troy Nolen, Windham, NH (US)

( * ) Notice: Subject to any disclaimer, the term of this patent is extended or adjusted under 35 U.S.C. 154(b) by 4 days.

(21) Appl. No.: 13/368,876

(22) Filed: Feb. 8, 2012

(65) Prior Publication Data

US 2013/0203019 A1 Aug. 8, 2013

(51) Int. Cl.
*G09B 19/00* (2006.01)

(52) U.S. Cl.
USPC ..... 434/16; 434/11

(58) Field of Classification Search
USPC ..... 434/11–72, 247–258; 42/7.01–7.09, 42/7.11; 702/138–140; 473/416; 340/514, 340/573.7; 273/271, 440, 451–452, 454, 273/456; 250/222.1
See application file for complete search history.

(56) References Cited

U.S. PATENT DOCUMENTS 4,352,665 A 10/1982 Kimble et al.
5,316,479 A 5/1994 Wong et al.
5,368,042 A 11/1994 O'Neal et al.
5,827,179 A 10/1998 Lichter et al.
RE38,877 E 11/2005 Trabut
7,291,014 B2 11/2007 Chung et al.
RE40,116 E 2/2008 Engstrom
7,506,468 B2 * 3/2009 Farrell et al. ..... 42/70.06
7,688,279 B2 3/2010 Miyamoto et al.
2009/0300685 A1 12/2009 Easter
2010/0214216 A1 8/2010 Nasiri et al.
2010/0221685 A1 * 9/2010 Carter ..... 434/19

* cited by examiner

*Primary Examiner* — Timothy A Musselman
(74) *Attorney, Agent, or Firm* — Lambert & Associates; Gary E. Lambert; David J. Connaughton, Jr.

(57) ABSTRACT

A training system is provided. The training system may have a handheld computing device configured to receive a data input from an input device. The input device may be a sensor capable of measuring a condition relating to the training. An analysis module in electronic communication with the handheld computing device is configured to interpret the data input from the input device and configured provide a feedback output related to the execution of the goals of the training system. Based on this feedback, a trainee or trainer may adjust the training program to enhance the trained skills.

18 Claims, 6 Drawing Sheets

TRAINING SYSTEM

BACKGROUND OF THE INVENTION

1. Field of the Invention

The present invention relates generally to a training system. More particularly, the present relates to a training system that utilizes input devices such as sensors in electronic communication with a computing device to track and record conditions—both of a local environment and a trainee.

2. Background of the Invention

For decades, the standard format of training shooters is one in which one or more students are taught by one or more instructors. New shooters are taught the theory of firearms and then are given practical instruction. Practical instruction includes being shown how to hold the weapon, sight the weapon and fire the weapon. Students are taught to hold their breath during the shot, to focus on the sights and to properly squeeze the trigger. An instructor walks up and down a shooting line behind the shooters observing what each shooter is doing correctly and incorrectly. The instructor then critiques the performance of each shooter.

Two problems make these techniques very inefficient. The first is that it is not possible for an instructor to watch all of the students all of the time. The second is that no matter how many times an instructor tells a student to hold his or her breath, or to squeeze the trigger, and even if the students believe that they are doing it, there is no simple way to confirm that they actually are. As such, these inefficiencies make training a shooter an expensive proposition in both money and time.

Therefore, what is needed is a system that may shorten the time needed to train a shooter, and that may minimize training, range, and ammunition costs.

SUMMARY OF THE INVENTION

The subject matter of this application may involve, in some cases, interrelated products, alternative solutions to a particular problem, and/or a plurality of different uses of a single system or article.

In one aspect, a training system is provided. The training system may comprise a handheld computing device configured to receive a data input from an input device. The input device may be a sensor capable of measuring a condition relating to the training. An analysis module in electronic communication with the handheld computing device is configured to interpret the data input from the input device and configured provide a feedback output related to the execution of the goals of the training system. Based on this feedback, a trainee or trainer may adjust the training program to enhance the trained skills.

In another aspect, a method of firearm training is provided. The method initially comprises attaching a handheld computing device in mechanical communication with a firearm. A sensor is configured to measure a condition relating to the firearm training, the sensor being electronically connected to the handheld computing device. An analysis module interprets data from the sensor and provides a feedback output. The output may be displayed and analyzed, allowing a trainee to tailor their training based this feedback.

In yet another aspect, a method of firearm training is provided. The method initially comprises attaching a handheld computing device in mechanical communication with a firearm. The handheld computing device is in wireless communication with a personal computer. A sensor is configured to measure a condition relating to the firearm training and electronically connected to the personal computer. An analysis module interprets data from the sensor and provides a feedback output. The output may be displayed on a display of the personal computer, and analyzed, allowing a trainee to tailor their training based this feedback.

DETAILED DESCRIPTION

Figure 1:
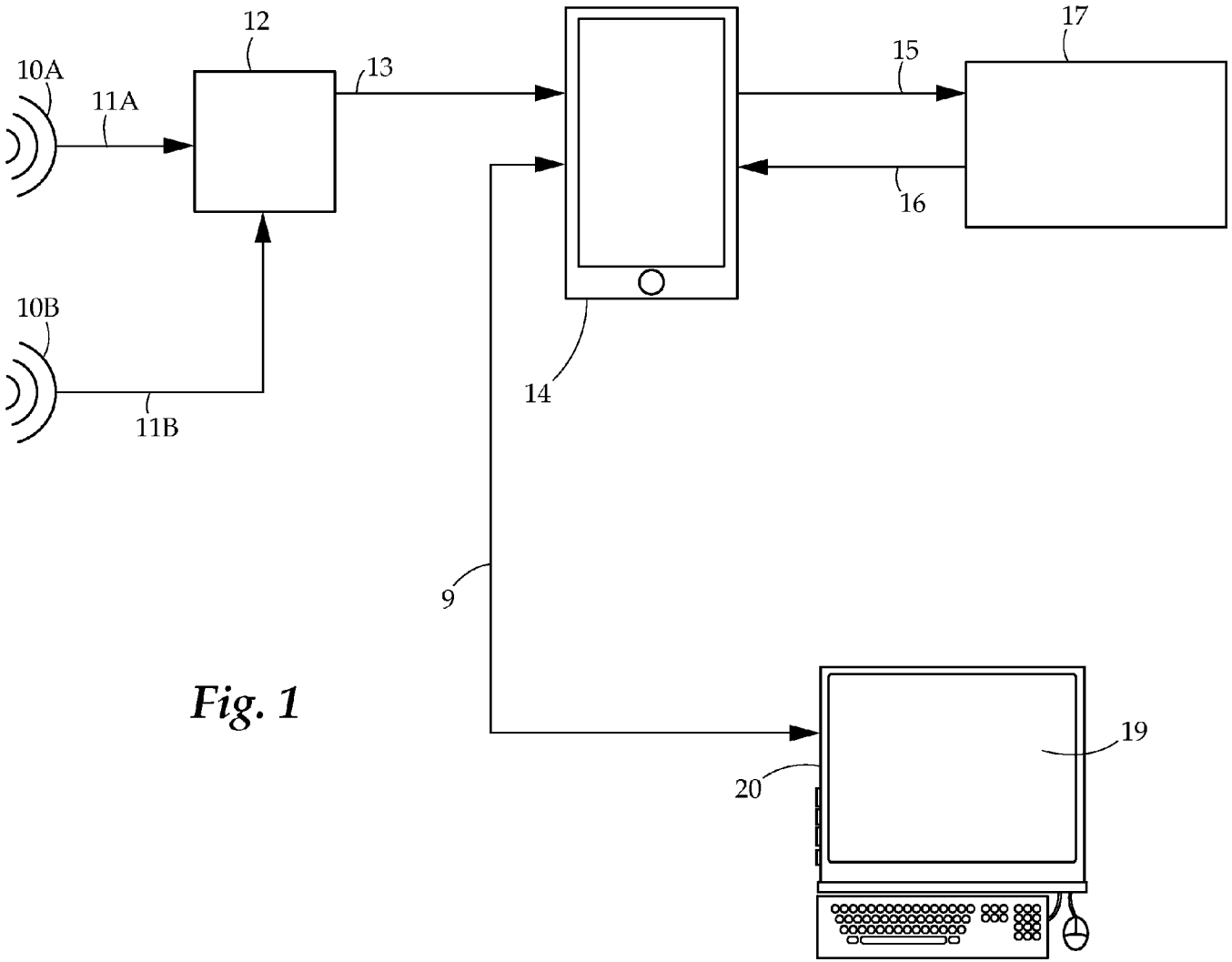
FIG. 1 provides a flowchart of an embodiment of the training system is provided.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a training system. In one embodiment, the present invention may be utilized for firearms training. However, the technology may be widely applied to, for example, aviation training, race car training, and the like.

In one embodiment, the present invention may generally comprise a handheld computing device in electronic communication with one or a plurality of input devices. The handheld computing device is configured such that the input devices may gather and measure information about a condition or conditions relating to the training. For example, input devices may gather information about conditions such as information about a trainee, and/or information about the external environment of the trainee. Further, an analysis module may be configured to interpret data gathered from the input devices to provide training feedback to a trainee to allow the trainee to improve based on the feedback.

The handheld computing device may be any mobile device capable of receiving inputs from input devices. In one embodiment, the handheld computing device may be a smartphone such as an iPhone®, Android® or the like. In another embodiment, the handheld computing device may be a personal digital assistant (PDA). In yet another embodiment, the handheld computing device may be a iPod® or similar handheld device. In still a further embodiment, the handheld computing device may be specifically designed and constructed to be used with the system of the present invention.

The input device or devices may be any device capable of sensing some element of an environment and providing input to the handheld computing device and/or an external computer. For example, input devices may be any devices capable of receiving conditions relating to the training including but not limited to, a camera, accelerometer, microphone, speaker, thermometer, pressure sensor, motion sensor, global positioning system, biometric sensor and the like. The biometric sensor may be configured to measure particular attributes of a user's body, including but not limited to respiration rate, user motion, gyroscopic user motion, trigger finger movement, muscle movements in general, eye position and movement, heart rate (via ECG or other), body temperature, skin conductance/galvanic skin response (GSR), and the like.

In one embodiment, the handheld computing device may have a plurality of input devices built into it. For example, in one embodiment the handheld computing device may comprise a camera, accelerometer, microphone, speaker, global positioning system (GPS) and visual display. The handheld computing device may further have a plurality of input devices positioned externally from the device, and in electronic communication there with. For example, in one embodiment, biometric sensors may be positioned on a body of a trainee, and may communicate with the handheld communication device.

In another embodiment, the handheld computing device may be in electronic communication with a personal computer such as a laptop or desktop computer. In one embodiment, the handheld computing device may be in wireless electronic communication with the personal computer. In these embodiments, the handheld computing device transmits data gathered from the input device to the personal computer. The personal computer may then process the information from the input device and provide feedback to a trainee. The personal computer may also store data from different training sessions to track trainee progress and provide a database of training logs. In another embodiment, the personal computer may be a remote server accessible by the handheld computing device via the internet.

In an alternative embodiment, the external input devices may communicate directly with a personal computer, with which the handheld computing device is also in electronic communication. In this embodiment, input data may be processed by an analysis module of the personal computer.

The wireless communication contemplated herein between, for example, the biometric sensors and the handheld computing device, or the handheld computing device and a personal computer may be performed by any suitable wireless transmission protocol. Examples of wireless communication methods may include WiFi, Bluetooth, ZigBee, infrared, cellular, and the like. It should be understood that any wireless communication may be equally effective if performed using a wired electronic connection.

In one embodiment, the present invention may be configured as a system for firearms training. In this embodiment, the handheld computing device may be mounted in mechanical communication with a firearm. The term mechanical communication may refer to mounting of the handheld computing device directly on a firearm, on an arm of a user firing a firearm. The latter example allowing the handheld computing device to be indirectly mechanically connected to the firearm through the arm of the user, which in turn is holding the firearm, or in any manner providing direct connection to the firearm, or connection to a structure which is in turn eventually attached to the firearm.

In embodiments where the present invention is used for firearm training using rifles, shotguns or other shoulder-fired firearms, the handheld computing device may be attached to a barrel of the firearm. A rifle mount may be used for this attachment. The rifle mount may comprise a barrel attachment portion, an arm, extending from the barrel attachment portion, and a clip, the clip configured to secure the handheld computing device. Preferably, the clip may be positioned on an opposite side of the arm from the barrel attachment portion.

In a further embodiment, the rifle mount may involve the clip being rotatably mounted to the arm, such that the clip may pivot, allowing a handheld computing device secured in the clip to be pivoted to direct any devices to a correct sensing direction.

In embodiments where the present invention is used for firearm training using handguns, the handheld computing device may be attached to a wrist mount. In this embodiment, the wrist mount may have a band or other structure that may allow attachment to a wrist or forearm of a trainee. The wrist mount may further comprise a clip which is pivotally mounted to the band. The pivotal attachment of the clip to the band may allow a handheld computing device secured to the clip to be pivoted to the appropriate position. In a further embodiment, an arm may attach the clip to the band.

The handheld computing device and/or the personal computer may be configured to be in electronic communication with one or a plurality analysis modules that may allow receipt, interpretation and output of various data from the input devices. The analysis module or modules may be any computing device configured, via hardware or software to perform this receipt, interpretation, and output. In this manner, the system may allow for the automated output of training feedback by the system based on the data collected from the environment and trainee by the input devices.

The term "in electronic communication with" is intended herein to refer to direct electronic communication, as well as indirect electronic communication, such as between devices, communication through a network, and the like. The following examples of analysis modules are provided by way of non-limiting examples only.

A video analysis module may utilize a camera of the handheld computing device to record video during a training session. The video may be of any element of value for the training. For example, in an embodiment where the system is used for firearms training, the eye motion of a trainee may be recorded and tracked to train proper eye movement, proper eye opening and sighting. A video analysis module may further allow review of the recorded video. In one embodiment, an instructor may review the video and provide feedback to the trainee. In another embodiment, a computer may review the video and provide feedback based on programmed analysis.

A trigger pull analysis module may be utilized to analyze and provide feedback on trigger pull behavior. For example, conditions analyzed may be whether a trainee has held their breath during the trigger pull, or whether a trainee is squeezing the trigger or pulling the trigger.

In one embodiment, the trigger pull analysis module may provide analysis of input data based on the trigger sensor. In one embodiment, a trigger sensor may be attached to a trigger of a firearm, which can sense trigger movement. In another embodiment, the trigger sensor may be configured as an Electromyography (EMG) sensor which may record the electrical impulses of muscles pulling the trigger finger. If improper technique is used, it may be detected by unwanted movement of the trigger.

In one embodiment, the trigger pull analysis module may provide analysis of input data based not only on the trigger sensor, but also on an accelerometer of the handheld computing device. In this embodiment, a trigger sensor may be attached to a trigger of a firearm, which can sense trigger movement. If improper technique is used, it may be detected by unwanted movement of the trigger detectable by the trigger sensor, as well as excess firearm movement detectable by the accelerometer.

In another embodiment, the trigger pull analysis module may provided analysis of input data based on the trigger sensor, and a biometric sensor that tracks trainee respiration. In this embodiment, proper trigger technique may be analyzed because shooters are trained to hold their breath when firing. In this embodiment, respiration at the time of trigger fire can be analyzed, and a feedback may be provided if improper technique was used.

In another embodiment, a firearm movement analysis module may be utilized to track proper firearm motion using an accelerometer in communication with the handheld computing device. If excessive motion is detected, the module may provide feedback indicating that there was excess firearm motion during aiming and firing, and provide instructions to a trainee to remedy the problem.

Further, biometric sensors may be utilized to measure an biologic functions of a user.

In another embodiment, a body movement analysis module may be utilized to track proper body movement using a biometric sensor that tracks trainee body movement. If excessive motion is detected, the module may provide feedback indicating that there was excess body motion during aiming and firing, and provide instructions to a trainee to remedy the problem.

An audio analysis module may be utilized to track audio from a shooting session. The audio module may be configured to record any type of audio for various uses. For example in one embodiment, the audio recording may be utilized to track respiration. In another embodiment, the audio may be used to analyze unusual sounds that may be occurring during the training. In another embodiment, the audio analysis module may be used to record firing times by recording the audio from firing the firearm.

A heart rate analysis module may be utilized to track and analyze heart rate of a trainee. In a further embodiment, this heart rate may be compared to other inputs. Heart rate may be tracked compared to other events that occur during training, such as firing, heat rate cycling, and the like.

A brainwave entrainment module may be provided to output specific audio patterns to reduce anxiety in the shooter. The brainwave entrainment module may receive inputs from sensors relating to an elevated anxiety level of a trainee, and provide audio output to seek to lower this anxiety. Some specific audio patterns may include binaural, monaural beats, and isochronic tones, among others. Inputs relating to an elevated anxiety level may include increased respiration and heart rate, excess sweating, shaking, muscle tension, and the like. These inputs may be measured by various sensors of the system. Alternatively, a trainer or trainee may activate the audio output manually.

It should be understood that various analysis modules may be utilized based on what input devices are utilized. Moreover, data from multiple input devices may be fed into an analysis module. For example, eye movement, firearm movement, trigger pull and respiration may all be incorporated into a single trigger pull analysis module to compare what a trainee's eye is focusing on during trigger pull (using a camera input device), if a trainee is properly holding their breath (using a respiration input device), and if a trainee is properly squeezing the trigger (using a trigger sensor, accelerometer, or the like). The module may then provide one or more outputs showing the data gathered. Optionally the particular module may provide analysis and feedback based on the data gathered. In one embodiment, the feedback may identify a training strength and provide positive feedback. In another embodiment, the feedback may identify a training deficiency, and may provide negative feedback and/or advice to address the training deficiency.

An example of feedback provided for the above noted embodiment may include a chart of trigger force over time, and a green, red or yellow signal to indicate good, bad, or medium execution of proper trigger pull.

Another example of feedback may be a chart indicating breathing rate over time coupled with a time marker for when the firearm was fired. The analysis provided may be a positive indicator if breathing was not detected at the time marker, or a negative indicator if breathing was detected at the time marker.

Further, the feedback may include providing advice such as text reminding the trainee to hold their breath while squeezing the trigger, thereby automatically addressing the training deficiency without an instructor looking over the trainee's shoulder.

Still another example may be a chart tracking eye movement over time with a time marker for when the firearm was fired. The analysis provided may be a positive indicator with proper eye movement, or lack thereof, and a negative indicator of excessive eye or improper movement.

In a further embodiment, each module may provide, as an output, a chart of the data analyzed compared to time, with a marker provided at each trigger pull. In this embodiment a trainer may review the output of all charts and provide feedback on his own. Alternatively, the modules may provide various outputs and feedbacks automatically. Feedbacks may include positive/negative markers, as well as text feedback providing tips and evaluation. Further still, a combination of the two embodiments may be employed, with some automatic feedback, coupled with review by an instructor.

The system may further comprise a computer memory in which the results provided by the analysis modules may be recorded. In later uses of the system, the recorded results may be accessed in the computer memory, and the previous results may be used to track progress, to identify recurring problems and problems that have been addressed. The system may further comprise a module to provide visual feedback tracking progress over time.

In some embodiments, some inputs may be manually provided by a trainee or instructor. For example, environmental conditions, location, firearm type, target distance, ammunition used, and the like may be suitable for manual input.

In other embodiments, the above noted inputs may be automatically retrieved. For example weather conditions could be accessed by a electronic communication between the system and a weather server, and firearm type could be scanned using a scanner connected to the system and a tag marked on the firearm.

In a further embodiment, a user interface of the system may be implemented on the handheld computing device, the personal computer, or both. The user interface may allow for multiple users to track multiple trainings under multiple conditions, allowing for a highly flexible, scalable implementation.

The user interface may begin with a login for a particular user in the event that a multi-user configuration is used. The login may access data stored relating to the logged in user. An administrator option may be provided that may allow access to any user and have a maximum amount of privileges that may be limited for other users.

Once logged in as a particular user, a series of data may be accessed. For example, a user may store data relating to multiple firearms. Access to a particular firearm may allow retrieval of training progress for a particular firearm, among other things.

In another embodiment, a user may store data relating to multiple optics such as scopes for the firearms. Access to a particular firearm may allow retrieval of training progress for that particular optic device, and the firearms they are used with, among other things.

Further still, a user may store data relating to multiple ammunitions. Access to a particular ammunition may allow retrieval of training progress for that particular ammunition, and the firearms it is used with, among other things.

The user interface may further comprise a series of calculators. The handheld computing device or personal computer may utilize these calculators to determine a number of ballistic related properties. Calculators may calculate, for example, elements such as bullet drop based on range and ammunition properties, target height, minute of angle, and bullet deceleration.

In one embodiment, the system may operate as follows: Initially, a user may access the user interface and select the proper conditions, gun, ammunition and the like. Next a session is initiated wherein the system is prepared to receive inputs from the various input devices. Depending on input devices used, there may be some calibration and integration required for each input device. A handheld computing device may be attached (directly or indirectly) to the firearm and configured to gather data from its on-board input devices. Any external input devices may be attached to their appropriate positions and electronically connected to the system. Once all input devices are configured and set to gather data, the firearm training may begin.

During training, the trainee may fire the weapon. During, and optionally before and after this firing, the system receives data from the various input devices. The system may use analysis modules to analyze the data either as it is received, or the data may be stored for review by the modules after the session is completed. Moreover, the analysis modules may provide feedback based on the data gathered, allowing the user and/or a trainer to interpret the feedback and make adjustments based on the feedback. This may be performed on the fly after each shot is fired, or may be performed in a batch after a training session, or after a plurality of shots. The feedback, as discussed above, may comprise charts, indicators, text, audio feedback and the like.

After the session has concluded, the system may provide a summary. Further the system may save the data gathered from the input devices, as well as the interpreted data and outputs from the analysis module(s) to a computer memory.

A similar system as described above could be utilized for racecar training. In this embodiment, sensors could be configured to sense vehicle features such as wheel turn position, throttle, brake, engine RPM, fuel, engine temperature, cabin temperature, and the like. Further, sensors could monitor driver conditions, such as eye tracking, body temperature, respiration, heart rate, in car audio and video, and the like. Analysis modules could be in communication with the sensors, and a computer (either handheld, personal or server) and a display may provide feedback output provided by the analysis modules. As such, the system of this embodiment may allow feedback to be provided to the racecar trainee based on the sensed and analyzed information.

Further, a similar system as described above could be utilized for aviation training. In this embodiment, sensors could be configured to sense aircraft features such as flap position, throttle, altitude, engine RPM, fuel, engine temperature, cabin pressure and temperature, and the like. Further, sensors could monitor aviator conditions, such as eye tracking, body temperature, respiration, heart rate, cabin audio and video, and the like. Analysis modules could be in communication with the sensors, and a computer (either handheld, personal or server), a display could provide feedback output provided by the analysis modules. As such, the system of this embodiment may allow feedback to be provided to the aviation trainee based on the sensed and analyzed information.

In another embodiment, a similar system as described above could be utilized for explosive disposal training, including disposal of improvised explosive devices (IED). In this embodiment, sensors could be utilized to sense operator features, bomb suit features, and environmental conditions such as body temperature, heart rate, eye tracking, respiration, bomb suit temperature, external and internal video and audio, disposal time, proper disposal technique, proper disposal step order and procedure while maintaining a calm demeanor, and the like. Analysis modules could be in communication with the sensors and a computer (either handheld, personal or server). A display could provide feedback output provided by the analysis modules. As such, the system of this embodiment may allow feedback to be provided to the explosive disposal trainee based on the sensed and analyzed information. In some embodiments, trainee progress may be tracked over time to measure bodily and other responses of a trainee under certain conditions.

In yet another embodiment, a similar system as described above could be used in anger management training. In this embodiment, sensors could be utilized to sense user bodily conditions to provide feedback to a user that they are experiencing anger related body responses. Bodily conditions may include body temperature, heart rate, eye tracking, respiration, blood pressure, and the like. Further, sensors could be utilized to sense external conditions that may trigger anger responses to record body reaction to various stimuli. For example, external video and audio may record unusual conditions, particularly when anger related body responses are sensed. Analysis modules could be in communication with the sensors and a computer (either handheld, personal or server). A display could provide feedback output provided by the analysis modules. As such, the system of this embodiment may allow feedback to be provided to the anger management trainee based on the sensed and analyzed information. Moreover, a trainee's biometric response to different situations may be recorded. As training continues, progress may be tracked to measure decreased anger related body responses over time.

It should be understood that the system may be utilized for various training systems where sensors may be used to analyze training progress, where feedback can be provided based on the analysis, and where a trainee or trainer may act on the feedback provided to enhance their training.

Turning now to FIG. 1 a flowchart of an embodiment of the training system is provided. External condition 10*a*, and potentially external condition 10*b* may be monitored by an input device 12 via inputs 11*a* and/or 11*b*. Data from the input device 12 is sent along path 13 to a handheld computing device 14. The handheld computing device 14 is in electronic communication with an analysis module 17. The analysis module may receive the data from the input device 12 along path 15, analyze it, and provide an output back to the handheld computing device 14 along path 16. Data path 9 provides electronic communication between the handheld computing device 14 and a computer 20. The computer 20 may display data relating to the training on a display 19.

Figure 2:
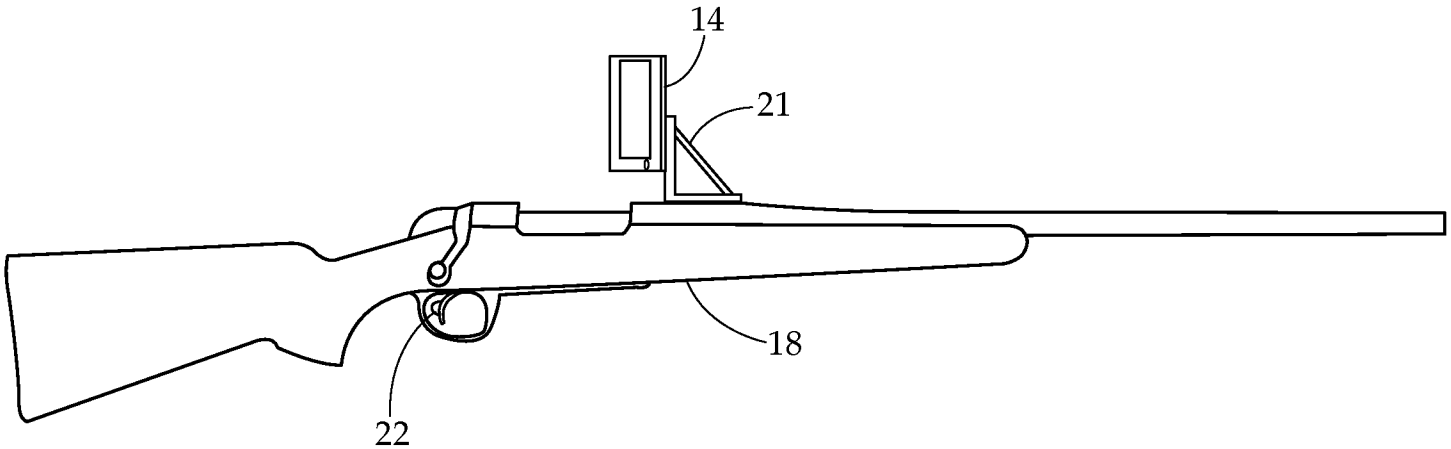
FIG. 2 provides a detail view of an embodiment of the handheld computing device attached to a firearm.

FIG. 2 provides a detail view of an embodiment of the handheld computing device attached to a firearm. In this view the handheld computing device 14 is attached to the firearm 18 by a mount 21. A trigger sensor 22 is in electronic communication with the handheld computing device 14 and configured to receive the condition of trigger movement.

Figure 3:
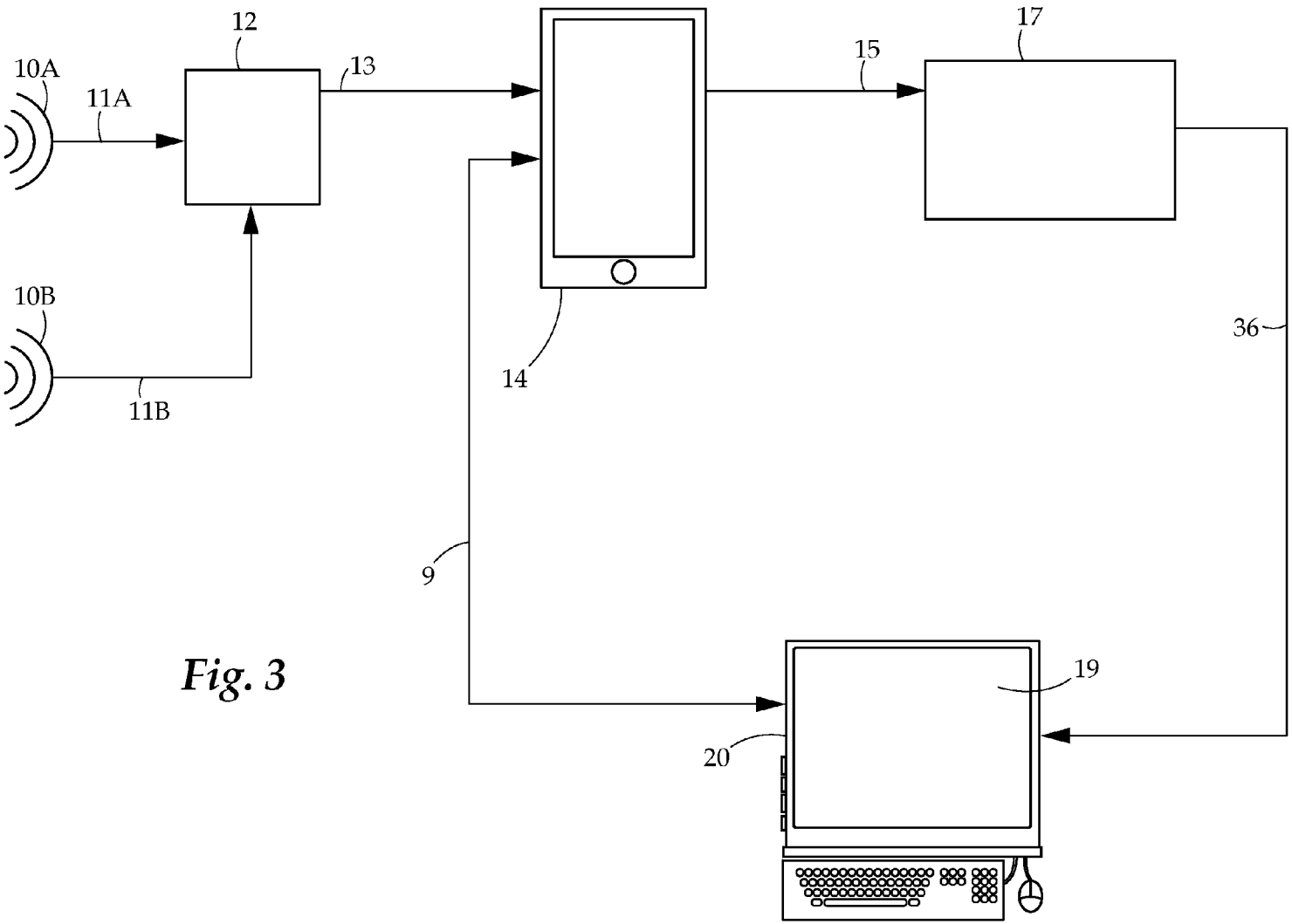
FIG. 3 provides a flowchart of another embodiment of the training system.

FIG. 3 provides a flowchart of another embodiment of the training system. External condition 10*a*, and potentially external condition 10*b* are monitored by an input device 12 via inputs 11*a* and/or 11*b*. Data from the input device 12 is sent along path 13 to a handheld computing device 14. The handheld computing device 14 is in electronic communication with an analysis module 17 along path 15. The analysis module may receive the data from the input device 12, analyze it, and provide an output to a computer 20 along path 36. Data path 9 provides electronic communication between the handheld computing device 14 and a computer 20. The computer 20 may display data relating to the training on a display 19.

Figure 4:
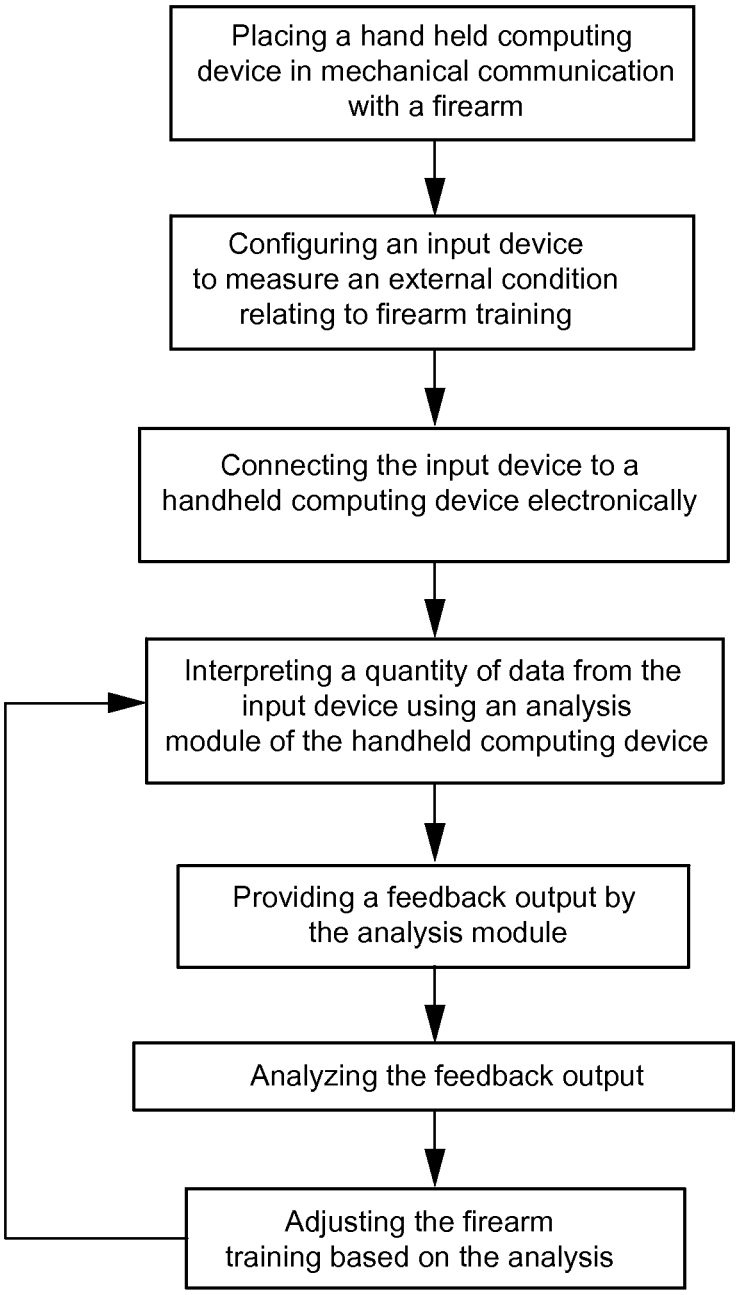
FIG. 4 provides a flowchart of steps of an embodiment of the training system.

FIG. 4 provides a flowchart of steps of an embodiment of the training system. The flowchart comprises the steps of placing a handheld computing device in mechanical communication with a firearm. Next, an input device is configured to measure an external condition relating to firearm training. This input device is connected to the handheld computing device electronically. Data from the input device is interpreted using an analysis module of the handheld computing device, and a feedback output is provided by the analysis module. This feedback output may be analyzed, and the training may be adjusted based on it. The training may continue and the feedback may continue to be interpreted until the training session is completed.

Figure 5:
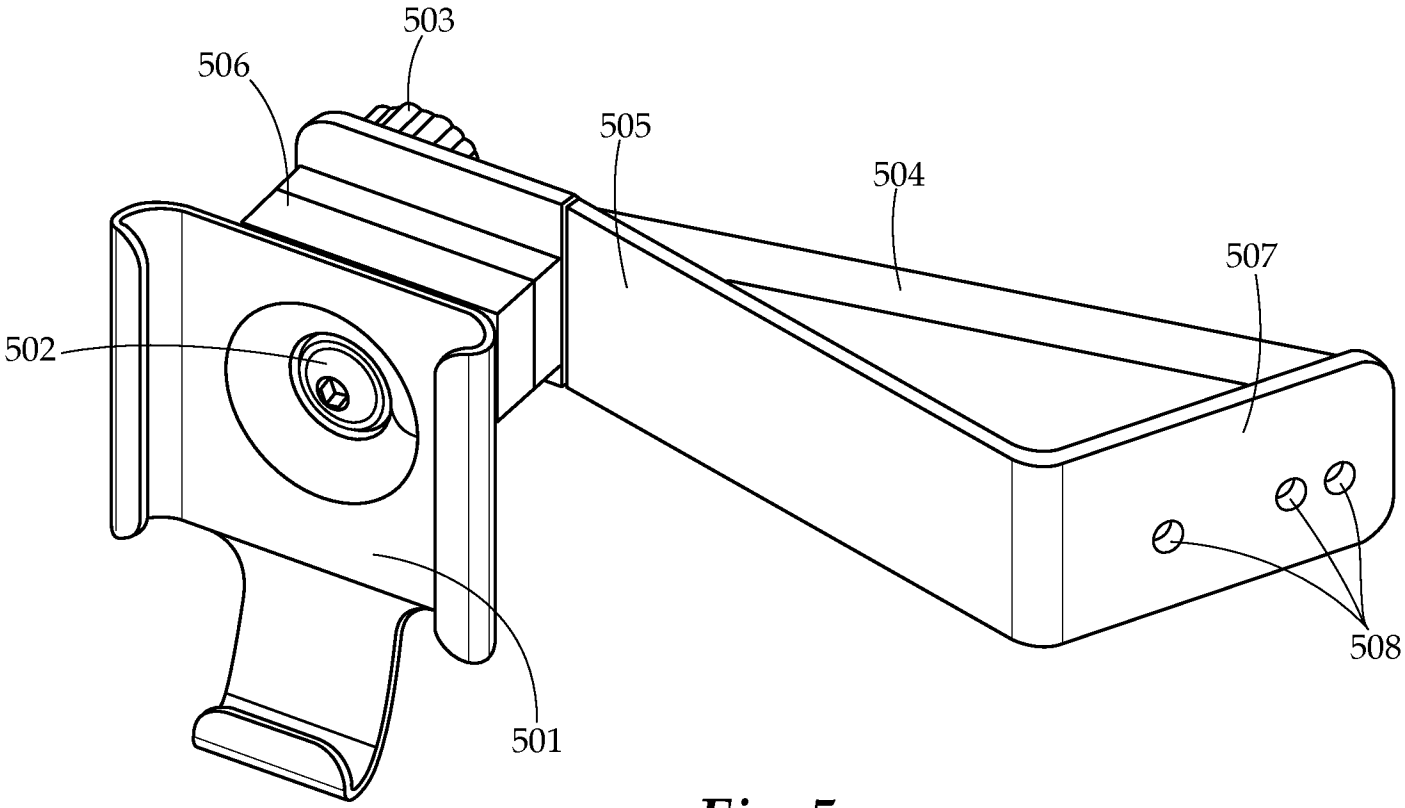
FIG. 5 provides an embodiment of a mount for placing the handheld computing device in mechanical communication with a firearm.

FIG. 5 provides an embodiment of a mount for placing the handheld computing device in mechanical communication with a firearm. A clip 501 is configured to receive the handheld computing device (not shown). The clip 501 may be constructed of any suitable material capable of supporting and securing the handheld computing device (not shown). For example, the clip 501 may be constructed of metals, plastics, composite materials, and the like. In one embodiment, the clip 501 may be constructed of Kydex®. This clip 501 is attached to a base plate 505 via a screw 502. Spacers 506 provide spacing between the base plate 505 and the clip 501. A knob 503 may allow tightening of the clip 501. The base plate 505 extends and is bent at an angle to form an attachment plate 507 to be attached to a firearm (not shown). A plurality of bolt holes 508 are provided, at least one of which may receive a bolt and be bolted to a firearm. A reinforcement 504 extends from a proximal end of the attachment plate 507 to a distal end of the base plate 505.

Figure 6:
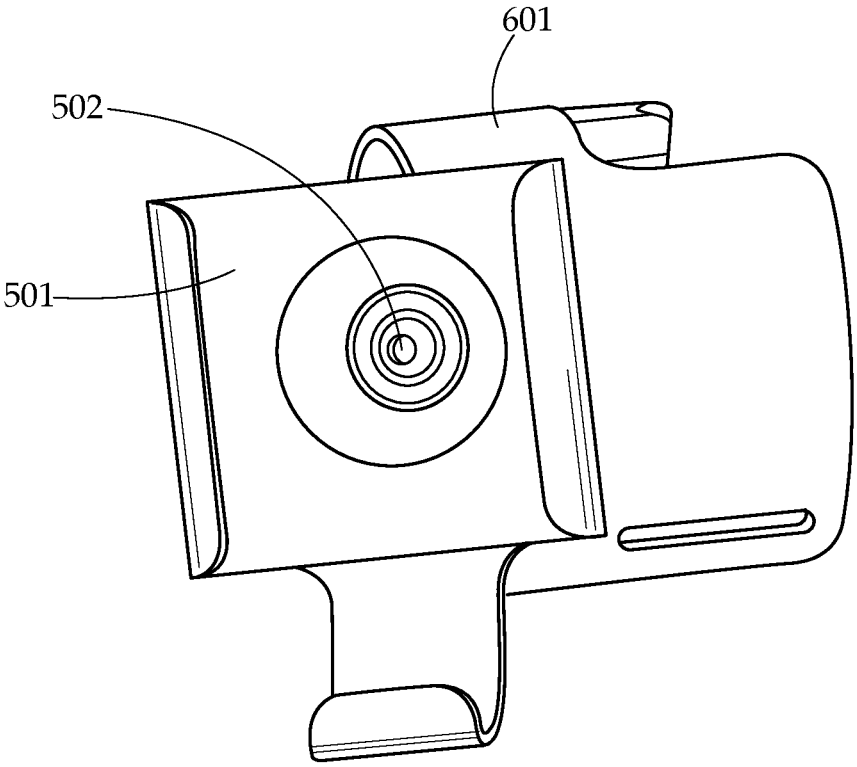
FIG. 6 provides an embodiment of a mount configured for use with a handgun.

FIG. 6 provides an embodiment of a mount configured for use with a handgun. A clip 501 is configured to receive the handheld computing device (not shown). This clip is attached to an armband 601 via a screw 502. The arm band 601 is adjustable to fit around a wrist or forearm of a user. The arm band 601 may be tightened to accommodate all user sizes.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A training system comprising:

a handheld computing device configured to receive a data input from an input device, wherein the input device is a sensor capable of measuring a condition relating to a training;

an analysis module in electronic communication with the handheld computing device, the analysis module configured to interpret the data input from the input device, the analysis module configured to provide a feedback output related to execution of a goal of the training system;

a firearm, the handheld computing device being in mechanical communication with the firearm;

wherein the training system is configured as a firearm training system; and wherein the input device is a device configured to measure an electrical impulse of a muscle pulling a trigger finger, wherein the condition relating to the training measured by the sensor is a trigger pull.

2. The training system of claim further comprising:

a second input device configured to measure a respiration of a user;

wherein the analysis module is configured to analyze the respiration of the user at a time of the trigger pull.

3. The training system of claim 1 further comprising:

a second input device configured to measure an eye movement of a user;

wherein the analysis module is configured to analyze the eye movement of the user at a time of the trigger pull.

4. The training system of claim 1 wherein the handheld computing device is in mechanical communication with the firearm by being attached to the firearm by a mount.

5. The training system of claim 4 wherein the handheld computing device is pivotally attached to the mount, the mount being attached to the firearm.

6. The training system of claim 1 wherein the handheld computing device is in mechanical communication with the firearm by being attached to an arm of a user who is holding the firearm.

7. The training system of claim 1 further comprising a plurality of input devices, wherein the handheld computing device is configured to receive a data input from each of the plurality of input devices.

8. The training system of claim 7 wherein the plurality of input devices comprise at least one of a camera, an accelerometer, a microphone, a biometric sensor tracking respiration, a biometric sensor tracking heart rate, a biometric sensor tracking body movement, a trigger action sensor and a weather sensor.

9. The training system of claim 7 further comprising a plurality of analysis modules in electronic communication with the handheld computing device, each of the plurality of analysis modules configured to interpret the data input from at least one of the plurality of input devices, each of the plurality of analysis modules configured to provide a feedback output based on the data input, the feedback output related to execution of the goal of the training system.

10. The training system of claim 1 further comprising a personal computer in wireless communication with the handheld computing device.

11. The training system of claim 1 further comprising a display, the analysis module being in electronic communication with the display, wherein the analysis module provides the feedback output in a visual format on the display.

12. The training system of claim 1 wherein the analysis module is configured to identify a training deficiency and to provide a quantity of advice to address the training deficiency.

13. A method of firearm training comprising the steps of:

placing a handheld computing device in mechanical communication with a firearm;

configuring an input device to measure a trigger pull by measuring an electrical impulse from a muscle of a user pulling a trigger finger;

connecting the input device to the handheld computing device electronically;

interpreting a quantity of data from the input device using an analysis module of the handheld computing device;

providing a feedback output by the analysis module;

analyzing the feedback output; and adjusting the firearm training based on the analysis of the feedback output.

14. The method of claim 13 wherein the step of placing a handheld computing device in mechanical communication with a firearm comprises:

attaching a mount to the firearm; and attaching the handheld computing device to a clip, the clip being pivotally connected to the mount.

15. The method of claim 13 wherein the step of placing a handheld computing device in mechanical communication with a firearm comprises:

attaching a mount to an arm of the user;

holding the firearm by the trainee; and attaching the handheld computing device to a clip, the clip being pivotally connected to the mount.

16. The method of claim 13 further comprising the steps of:

configuring a plurality of input devices, each of the plurality of input devices configured to measure a different condition relating to the firearm training; and connecting the plurality of input devices to the handheld computing device electronically.

17. A method of firearm training comprising the steps of:

placing a handheld computing device in mechanical communication with a firearm;

configuring an input device to measure an eye movement of a user during firing of the firearm;

connecting the input device to the handheld computing device electronically;

interpreting a quantity of data from the input device using an analysis module in communication with a computer;

providing a feedback output by the analysis module;

displaying the feedback output using a display of one of the handheld computing device or the computer;

analyzing the feedback output; and adjusting the firearm training based on the analysis of the feedback output.

18. The method of claim 17 further comprising the steps of:

configuring a plurality of input devices, each of the plurality of input devices configured to measure a different condition relating to the firearm training; and connecting the plurality of input devices to the handheld computing device electronically.

* * * * *